United States Patent [19]

Crabb, Jr.

[11] Patent Number: 4,519,178

[45] Date of Patent: May 28, 1985

[54] METHOD AND APPARATUS FOR PLACING TAGS ON PRODUCE AND THE LIKE

[75] Inventor: Richard V. Crabb, Jr., Aromas, Calif.

[73] Assignee: Salinas Valley Engineering & Manufacturing, Inc., Salinas, Calif.

[21] Appl. No.: 513,608

[22] Filed: Jul. 14, 1983

[51] Int. Cl.[3] ..... B65B 27/10; B65B 61/26

[52] U.S. Cl. ..... 53/137; 53/556; 53/585; 53/415; 40/20 R; 100/9

[58] Field of Search ..... 53/415, 138 R, 138 A, 53/137, 556, 585; 100/9; 40/20; 206/805; 493/375

[56] References Cited

U.S. PATENT DOCUMENTS

| | | | |
|---|---|---|---|
| 1,005,894 | 10/1911 | Senseman | 40/20 R |
| 3,313,090 | 4/1967 | Kerrigan | 53/585 X |
| 3,370,779 | 2/1968 | Cole | 40/20 R |
| 3,732,662 | 5/1973 | Paxton | 53/415 |
| 4,188,871 | 2/1980 | Teachout | 100/9 X |
| 4,470,241 | 9/1984 | Parry | 53/585 X |

FOREIGN PATENT DOCUMENTS

| | | | |
|---|---|---|---|
| 937210 | 11/1973 | Canada | 53/138 A |
| 6702023 | 2/1967 | Netherlands | 206/805 |

*Primary Examiner*—John Sipos
*Attorney, Agent, or Firm*—Gerald L. Moore

[57] ABSTRACT

Apparatus for bunching vegetables and like articles and for placing a closure or tag thereon comprising a plurality of arms (27) for holding and stretching an elastic band and a channel (34) along which is fed a strip (15) of tags. As the elastic band is stretched taut to a smaller cross section, it intersects the tag and enters the aperture (20) therein. With relaxation of the elastic band the tag is pulled from the strip and remains on the band to identify the bunched articles. Bending of the strip by the arm end (45) weakens the strip connecting webs (17) to allow separation of the end tag.

4 Claims, 8 Drawing Figures

METHOD AND APPARATUS FOR PLACING TAGS ON PRODUCE AND THE LIKE

FIELD OF THE INVENTION

This invention relates to apparatus for placing identification tags on bunches of produce and the like.

BACKGROUND OF THE INVENTION

Many vegetables such as broccoli, celery, carrots and the like are bunched and tied for shipment to the market and for sale in the supermarket. While several methods for bunching are used today, one of the most advantageous holds the bunches by use of a rubber band. The rubber band is placed around the bunches and the bunches are inserted into shipping cartons for transport to the market.

With the various advertising and promotion programs to build the market, suppliers of produce prefer to place an identification on their produce. Also many suppliers desire to communicate recipes and other information to the consumer. Also where other articles other than produce are bunched, identification or other information may be necessary. One method involves placing the produce in plastic bags having identification and other information thereon; also attempts have been made to print on the rubber bands used for bunching the vegetables. Both methods have their particular disadvantages.

It is the primary purpose of the subject invention to provide a simple yet effective method and apparatus for identifying and otherwise communicating information to the consumer of bunched vegetables and other products.

SUMMARY OF THE INVENTION

The method and apparatus for bunching vegetables and like products wherein means are provided for holding and feeding forward a tag having an opening therein for receiving a rubber band, means for aligning the tag with a predetermined path, means for receiving and stretching a rubber band to traverse said predetermined path so as to cause the stretched and reduced area of the rubber band into engagement with the tag, means for relaxing and allowing the rubber band to expand in cross sectional area so as to attach to and pull the tag from the holder thereby attaching the tag to the rubber band.

DESCRIPTION OF THE INVENTION

Figure 1:
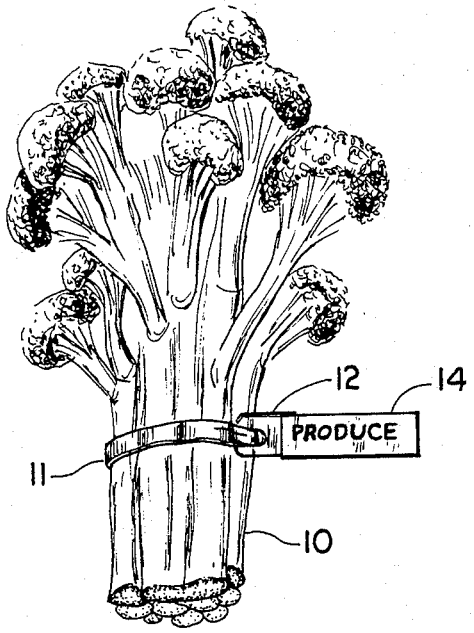
FIG. 1 shows bunched produce with a rubber band and identification tag attached.
Figure 2:
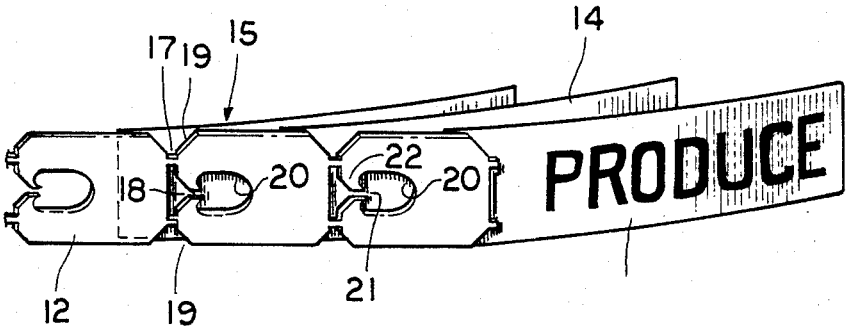
FIG. 2 shows the identification tags attached together.

In FIG. 1 is shown a typical bunch 10 of broccoli which is held by a rubber band 11. This produce is typical of the type of product which growers desire to have identified with their trademark. For this purpose a closure 12 fixed to the rubber band can either have printed thereon the necessary information or can have attached thereto a label 14. These closures are made in a combination closure-label strip 15 (FIG. 2) embodying a series of consecutive closures 12 which are integrally connected by webs 17 and have secured thereto by glue or the like (not shown) a series of paperboard labels 14.

The strip 15 is made of a plastic material that is relatively thin and stiff. The plastic material is weakened at regularly spaced intervals along transverse lines normal to the side edges of the strip by the formation of a hole 18 bordering said transverse line. There is also formed in opposite side edges of the strip at each such line a pair of notches 19 with the inner points of the notches being separated from the outer extremities of the holes 18 by the webs 17 which integrally unite consecutive closures. Each closure 12 is provided with an aperture 20 which is disposed adjacent and connected to one of the holes 18 by a narrow opening 21 positioned between the notches 19. The label 14 is fixed to the closure near the end opposite the aperture 20.

Figure 3:
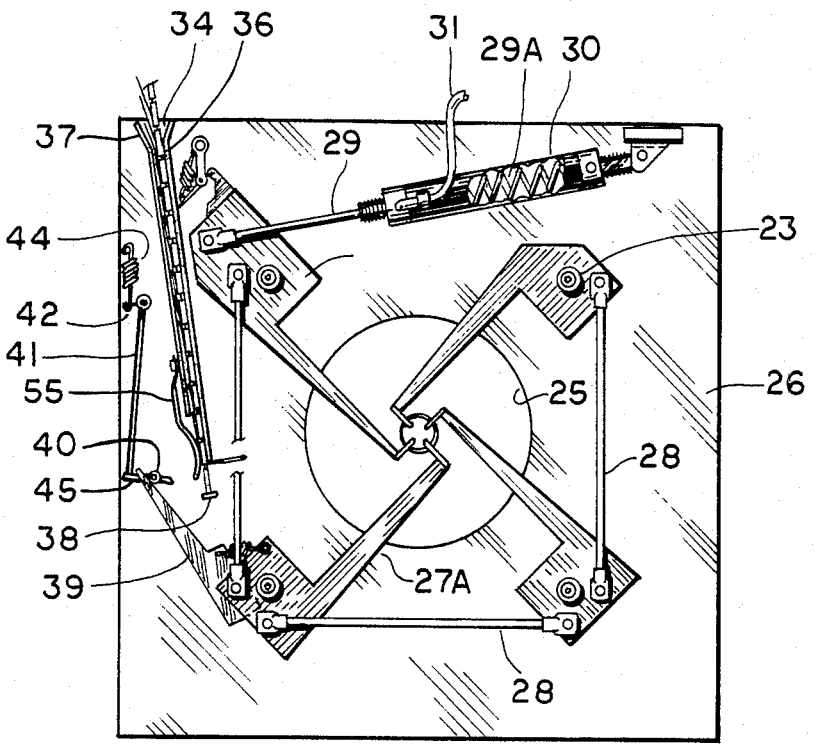
FIG. 3 shows the apparatus for bunching, placing the rubber band around the bunch and placing the tags on the rubber band.
Figure 4:
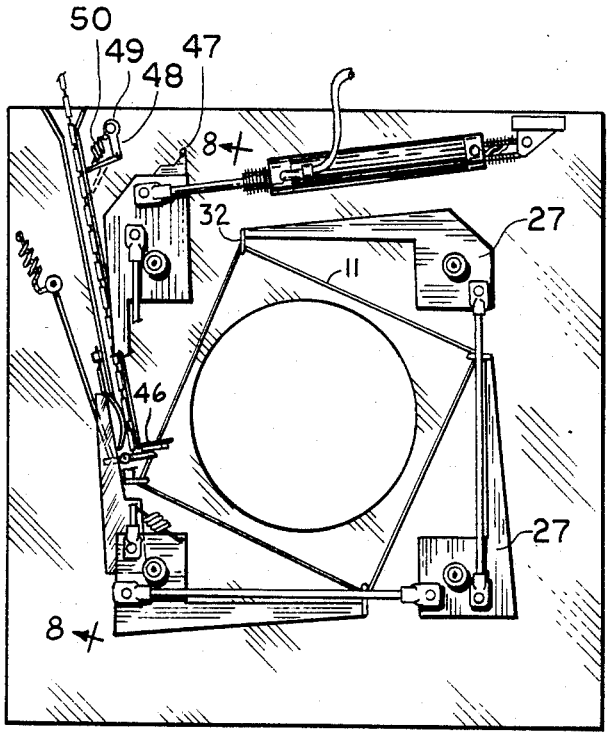
FIG. 4 shows the rubber band in the stretched position to receive the tag.
Figure 5:
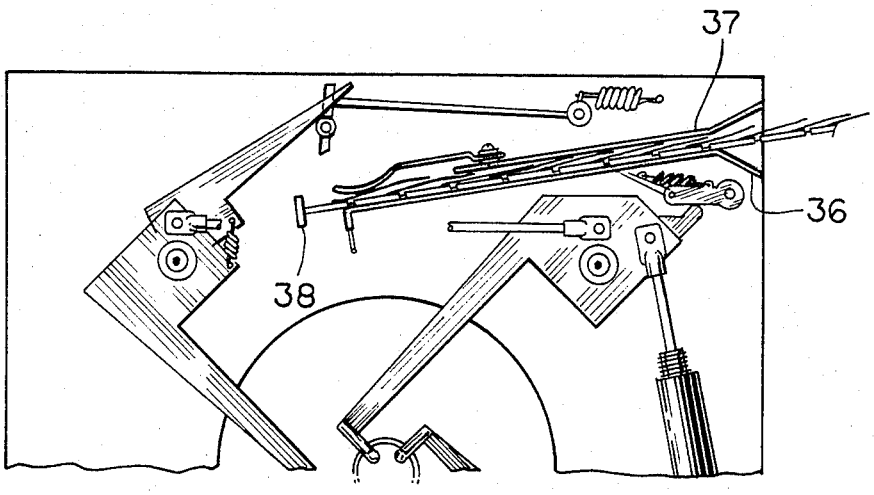
FIGS. 5, 6 and 7 show the rubber band attachment apparatus in various operating positions.
Figure 6:
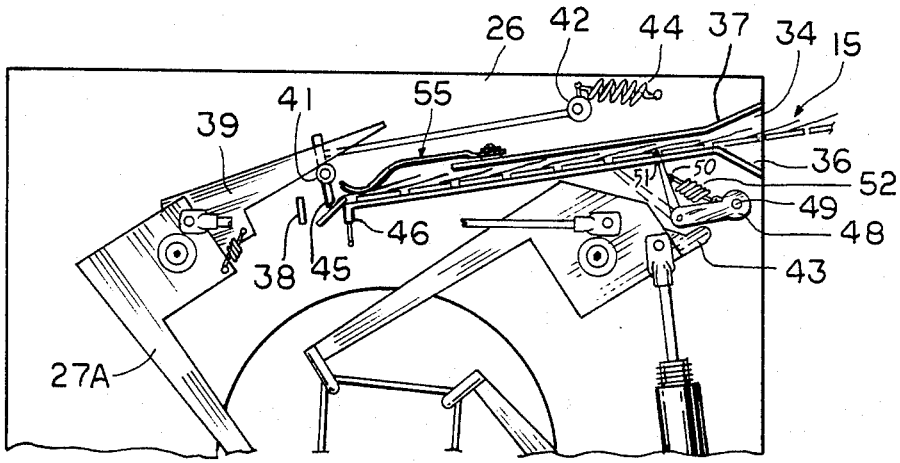
Figure 7:
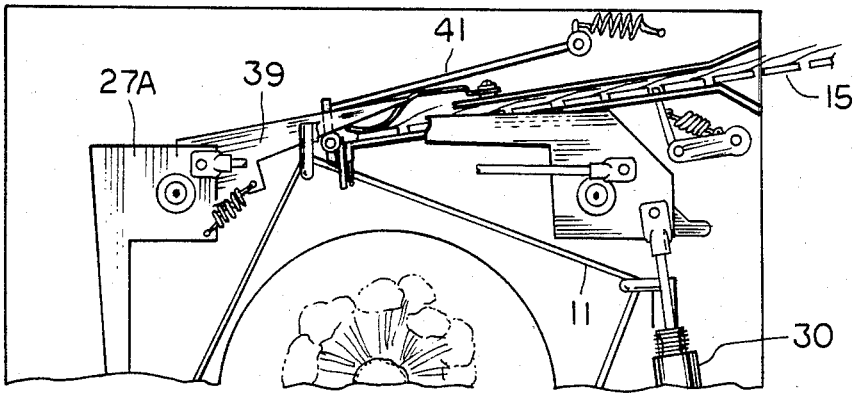
Figure 8:
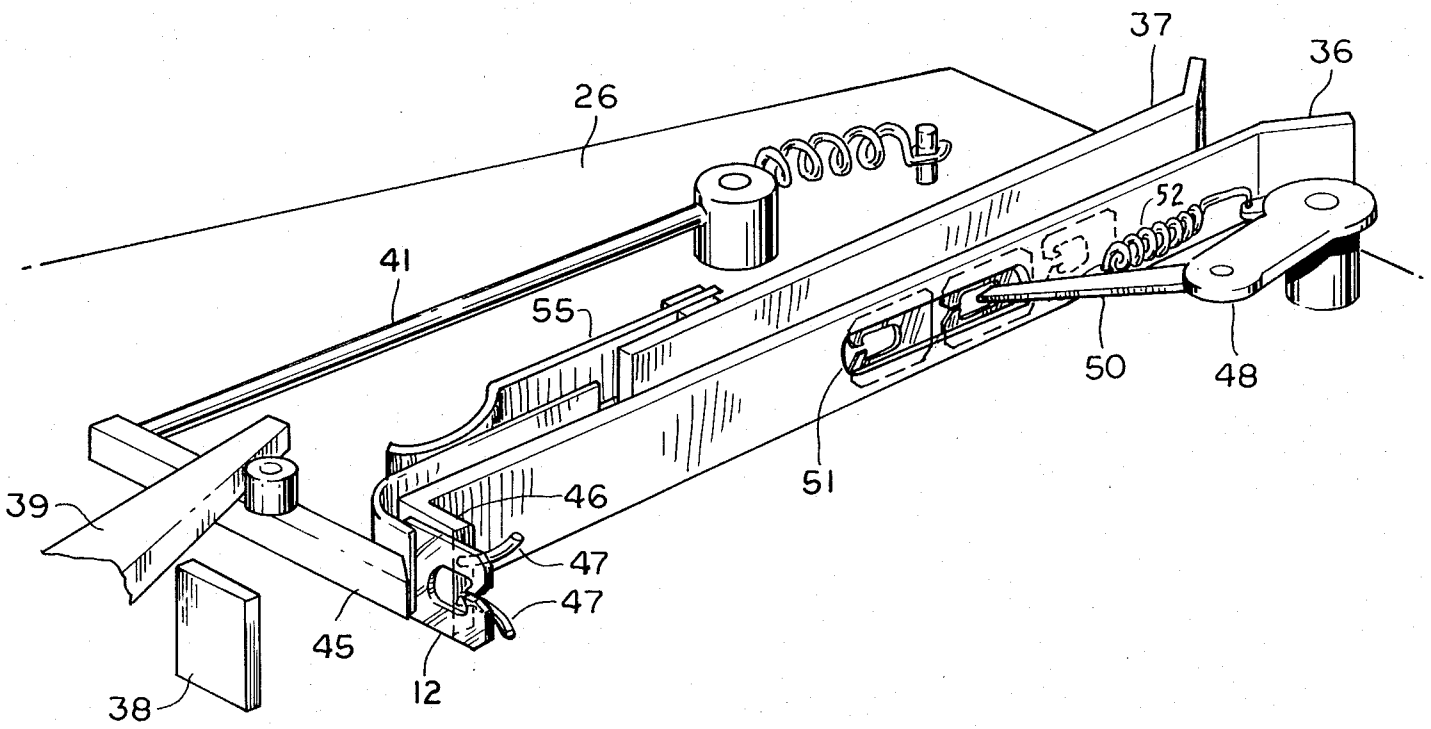
FIG. 8 is an enlarged view along the line 8—8 of FIG. 3.

The produce is bunched by first being grouped together and then being inserted through an opening 25 in a plate 26 (FIGS. 3 and 4) having stretched therearound the rubber band 11 as shown in FIG. 4. The apparatus for stretching the band comprises a plurality of arms 27 each supported on the plate 26 by a pivot 23. Thus each arm can pivot in a plane parallel to the plane of the plate. The arms are attached together by a series of rigid linkages 28 which are pivotally attached thereto with one arm being pivotally attached to a rod 29 extending to an actuator 30. By supplying pressured fluid through a tube 31, the actuator can be caused to move the rod 29 for pivoting the arms in unison to the position shown in FIG. 4. Normally the compression spring 29A located inside the actuator maintains the arms in a position shown in FIG. 3.

Each arm carries at the end a hook 32 having a tip extending normal to the arm and on which the rubber band can rest when the arms are moved to the centering position. When the arms are actuated to the extended position the rubber band is stretched therebetween for insertion of the bunch 10 and thereafter by relaxation of the arms the rubber band is allowed to close around the bunch. For a more thorough description of this apparatus reference can be made of U.S. patent application Ser. No. 06/380,515 filed on May 21, 1982 now U.S. Pat. No. 4,470,241 with Curtis L. Parry et al as inventors and entitled Apparatus for Bunching, Trimming and Banding Vegetables.

It has been found that a closure 12 can be placed on the rubber band 11 in the manner shown in FIG. 1 for identification of the origin of the produce or articles and such other information as desired by the supplier. In accordance with the invention the rubber band is stretched to reduce the cross section thereof and to hold a section taut. Thereafter the band and closure are brought together with the band in alignment with the opening 21 for passage thereof between the holding points 22 and into the aperture 20. Because of the ribbon cross section, the band will pass between the holding points and thereafter flatten thereagainst as it is relaxed to separate the closure from the strip with severance of the webs 17 by mechanically breaking the attached points of the closure. The closure thus remains on the band as the band is relaxed around the produce. Thus the band functions to assist in separating the closure from the strip.

In accordance with the invention the closure is placed on the rubber band 10 as it is stretched for placement around the bunch. In this manner the rubber band serves to assist in separating the closure from the strip and the closure is positioned on the strip as the band is stretched. The strip 15 is fed into a channel 34 formed by the parallel guides 36 and 37 and moved forward until the forward end contacts an abutment 38. Usually the strip is wound in a spiral and a flat magazine (not shown) can be provided. Thereafter with actuation of the arms, the arm 27A is rotated in the clockwise direction to carry with it an attached lever 39. This lever rides against a pin 40 fixed to a second lever 41 pivotally fixed to the plate 26 by a pin 42. A spring 44 normally keeps the second lever into contact with the first lever.

With rotation of the first lever, the second lever is pushed until the normally extending end 45 contacts the forward closure and bends that closure at the webs 17 to extend normal along a guide 46 forming an extension of the guide 36. This guide 46 includes guides 47 aligning generally with the aperture 20 of the closure and also with the path of the rubber band as it is stretched. Thus the band is forced through the opening 21 and into the aperture 20. The band naturally is turned sidewise as it passes between the points 22 and thereafter flattens again so that with relaxation thereof the closure is pulled from the strip and remains on the rubber band. The webs 17 are substantially broken when the lever end 45 bends the strip.

With relaxation of the actuator 30 the band is allowed to relax around the bunch and a third lever 43 contacts an arm 48 pivotally attached to the plate 26 by a pin 49. Attached to the other end of this arm is a detent 50 extending through a slot 51 in the guide 36. A spring 52 extends between the third arm 48 and detent. Thus as the lever 48 is rotated in the clockwise direction the detent drops into the aperture 20 of the strip and with further movement, shifts the strip lengthwise to move the end thereof once again into contact with the abutment 38. A spring 55 holds the end of the strip into close contact with the guide 36 so that the web 17 will be broken as the next closure is folded against the guide 46. The spring 55 allows passage of the label 14 through the guides 36 and 37 and the bending of the strip for separation of one closure and label therefrom.

Thus it can be seen that the closure is placed on the rubber band and the band is manipulated in the normal manner for placement on the bunch. The taut and therefore reduced cross section of the rubber band allows passage of the band between the holding points of the closure to thereafter contact the points as the rubber band is relaxed to pull the closure from the strip.

The invention claimed:

1. Apparatus for bunching and marking articles with a closure having an opening in one of its sides for receiving a ribbon object, said apparatus comprising:

a plurality of holding means each movable between first and second positions for receiving and holding an endless elastic band when in the first position and for stretching the elastic band to form a larger opening therethrough for placement of articles into said band opening and for reducing the cross section of the band when in the second position;

means for holding a closure in position for the opening therein to intersect the elastic band as the arms are moved from the first to the second position to cause the band to enter the opening;

moving means to move said holding means from the first to the second position to stretch the band and cause relative movement between said band and closure to cause said band to enter said closure openings; and means to move the arms from the second to the first position with the elastic band attached to allow the elastic band to relax and increase in cross sectional area to pull and separate the closure from the holding means.

2. The apparatus as defined in claim 1 wherein said means to hold a closure includes a guide for holding a plurality of closures fixed together in a strip.

3. The apparatus as defined in claim 2 including means for bending the first closure of the strip relative to said strip to assist in separating the first closure from said strip.

4. The apparatus as defined in claim 3 including means to advance said strip lengthwise when said first closure is separated from said strip.

* * * * *